US005797501A

United States Patent [19]

Von Gunten

[11] Patent Number: 5,797,501

[45] Date of Patent: Aug. 25, 1998

[54] GRAVITY SHELF STRUCTURE SUPPORT

[76] Inventor: Lee Louis Von Gunten, 64 Newton Dr., Buffalo Grove, Ill. 60090

[21] Appl. No.: 777,876

[22] Filed: Dec. 31, 1996

[51] Int. Cl.[6] ..... A47F 5/08; F16B 7/00

[52] U.S. Cl. ..... 211/90.01; 211/187; 211/183; 403/292; 403/300; 108/180; 108/91

[58] Field of Search ..... 211/90.01, 90.02, 211/103, 208, 187; 403/292, 294, 300, 309–511, 313; 248/159; 108/108, 180, 186, 42, 48, 91

[56] References Cited

U.S. PATENT DOCUMENTS

| | | | |
|---|---|---|---|
| D. 347,343 | 5/1994 | Von Gunten . | |
| 2,654,487 | 10/1953 | Degener | 108/91 X |
| 3,265,217 | 8/1966 | Biggs | 211/90.02 |
| 3,285,208 | 11/1966 | Cohen | 108/108 X |
| 3,325,017 | 6/1967 | Tucker | 211/187 X |
| 3,339,751 | 9/1967 | Bard | 211/187 X |
| 3,352,191 | 11/1967 | Crawford | 403/292 X |
| 3,465,898 | 9/1969 | Klein | 108/91 X |
| 3,671,062 | 6/1972 | Ashworth | 403/292 |
| 3,729,218 | 4/1973 | Gutmann | 403/300 X |
| 3,848,844 | 11/1974 | Barrett . | |
| 3,873,220 | 3/1975 | Kashiwabara | 403/292 X |
| 3,900,269 | 8/1975 | Pavlot | 403/292 |
| 4,088,414 | 5/1978 | Fallein | 403/292 X |
| 4,117,783 | 10/1978 | Eckel et al. | 108/91 |
| 4,238,550 | 12/1980 | Burgees et al. | 211/183 X |
| 5,127,762 | 7/1992 | Havlovitz | 103/300 X |
| 5,303,830 | 4/1994 | Metcalf | 211/103 X |
| 5,348,385 | 9/1994 | Berg . | |
| 5,477,789 | 12/1995 | Von Gunten . | |
| 5,517,928 | 5/1996 | Erdman | 108/180 |
| 5,540,340 | 7/1996 | Betteley et al. | 211/187 X |
| 5,642,820 | 7/1997 | Angeles | 211/103 |

*Primary Examiner*—James R. Brittain
*Assistant Examiner*—Robert J. Sandy
*Attorney, Agent, or Firm*—James P. Hanrath

[57] ABSTRACT

A joinder piece for connection of sectional or segmental support members, at least one of the support members having a plurality of aligned slots to receive seating hooks of a cantilever bracket, comprises an elongate body having an opening or trough which is partially inserted into at least one of the support members. The elongate body has a base portion bordered by a first side portion and a second side portion to form the opening or trough opposite the base portion which is capable of being disposed in alignment with the plurality of aligned slots of the support member. The base portion of the elongate body preferably has an indentation to divide the base portion into a first base portion section and a second base portion section which are non-linear along their combined external base portion surfaces. The base portion may also have an inwardly extending ridge along at least a part of its length.

31 Claims, 4 Drawing Sheets

GRAVITY SHELF STRUCTURE SUPPORT

BACKGROUND OF THE INVENTION

1. Field of the Invention.

The present invention relates generally to shelving structures and more specifically to a gravity shelf structure support, particularly a joinder piece for connection of sectional or segmental wall post or support members for shelving, especially sectional or segmental vertical wall posts having aligned slots to receive seating hooks of a cantilever bracket.

2. Description of the Related Art.

A common form of shelving structure used to support commercial merchandising displays as well as home decor arrangements utilize cantilevered brackets mounted on support members. The support members may be in the form of slotted vertical standards or posts mounted on a wall or free-standing slotted columns affixed to the floor and ceiling or otherwise stabilized. Such support members are typically provided with a plurality of aligned or vertically spaced slots dimensioned to receive seating hooks of a bracket in interlocking engagement with the support members in a cantilevered fashion.

Although some bracket/wall standard systems are designed to be permanent installations, the changing merchandising display needs of commercial users as well as the decor arrangements of home users make it desirable that the brackets be able to be changed and rearranged between multiple positions in the support members with relative ease and economy and without damaging the finish thereof. Accordingly, ease of installation, flexibility of bracket settings, portability, secure engagement of the bracket to support member, ease in disengagement, as well as the cost and ornamental or sightliness appearance of the bracket are important factors in modern integrated merchandising, storage, and home decor shelving units.

In my U.S. Pat. No. 5,477,789, the entire disclosure of which is hereby incorporated herein by reference, there is disclosed a self-stabilizing post for use in a bracket/wall standard system. In this system, the support member or wall standard post is preferably of a single integral, one-piece member construction.

In the prior art, posts or support members were usually one piece of fixed overall height or length, or if segment, they were joined by mounting of the support members upon an internal circular solid rod.

However, in accordance with the present invention, an additional degree of flexibility is given to a shelving, wall support, hang rod, cantilever, or other support system when the support members or posts for the cantilever brackets are of sectional or segmental sections such that the overall height or length of a support members or posts can be varied according to the needs of the user. In this regard, the present invention provides a load bearing joinder piece for connection of such sectional or segmental support members which is cooperative with aligned slots of the support member used for removable receipt of seating hooks of cantilever brackets.

SUMMARY OF THE INVENTION

In accordance with the present invention there is provided a joinder piece for connection of sectional or segmental support members, at least one of the support members having a plurality of aligned slots to receive seating hooks of a cantilever bracket, comprising an elongate body having an opening, the elongate body having a base portion bordered by a first side portion and a second side portion to form the opening opposite the base portion, the opening being capable of being disposed in alignment with the plurality of aligned slots of the support member upon at least partial insertion of the joinder piece into the support member.

In a second embodiment of the invention, the joinder piece may be modified such that the elongate body has a trough as opposed to an opening suited to receive the seeding hooks of a cantilever bracket.

The present invention advantageously provides increased flexibility to a shelving, wall support, hang rod, cantilever, or other support system by allowing the support member or post to be segmental or sectional to thereby accommodate various overall heights or lengths of the same according to the needs of the user. Also, the first and second side sections of each of the joinder piece embodiments are preferably in contour curved toward each other and are capable of an inward movement toward each other to accomplish an interference fit within a sectional or segmental support member. Additionally, the base portion optionally, but preferably, has an inwardly extending ridge extending the length of the base portion opposite the opening or trough of the elongate body. This ridge is capable of a transferring a load induced force resultant from a load borne by the cantilever bracket and/or its associated hang rod or shelf board structure to the base portion within the sectional or segmental support member so as to aid in the disposition of the support member to a support surface.

The joinder piece of the present invention may be a single elongate body as described above wherein one half of the elongate body is of an slightly greater diameter than its other half. The greater diameter half, as hereinafter described, can be permanently locked mounted within a sectional or segmental support member in a fashion so as to expose the other half for a selective and removable mounting within an open end of a complimentary sectional or segmental support member without resort to any tooling or screws or other mechanical means.

Still further, the base portion of the joinder piece may be provided with an indentation in its external surface designed to achieve multiple advantages. For example, the indentation when extending substantially across the width of the base portion will create a bulge point bordering each side of the indentation. The bulge points foster an interference fit of that portion of the joinder piece into a sectional or segmented support member to thereby permanently lock the same therein. Further, the indentation serves to divide the base portion of the joinder piece into a first base portion section and a second base portion section which are non-linear along their combined external surfaces. This allows for one of the first or second based portion sections to be biased in a direction extending opposite the opening or trough of the elongate body such that the biased external surface of that base portion section is resilient and capable of an inward movement towards the opening or trough of the elongate body upon bearing the force of a load placed upon the sectional or segmented support members. Thus, the non-linear combined external surfaces of the first and second base portion sections formed by the indentation cooperates with the optional, but preferred, inwardly extending ridge, along at least a part of the base portion, to thereby provide multiple load-bearing components to the joinder piece and to increase the loadbearing capacity of the joinder piece and sectional or segmented support members. The increased load-bearing capacity has a cumulative impact when there are multiple joinder pieces and segmented support members forming a wall post support system.

Still further, the joinder piece of the present invention may be formed by a relatively non-complex process starting with a round tube and subjecting the same to specified pressures.

Additional features and advantages of the present invention will become apparent to those skilled in the art from the following description and the accompanying figures illustrating preferred embodiments of the invention, the same being the present best mode for carrying out the invention.

DESCRIPTION OF THE PREFERRED EMBODIMENTS

Figure 1:
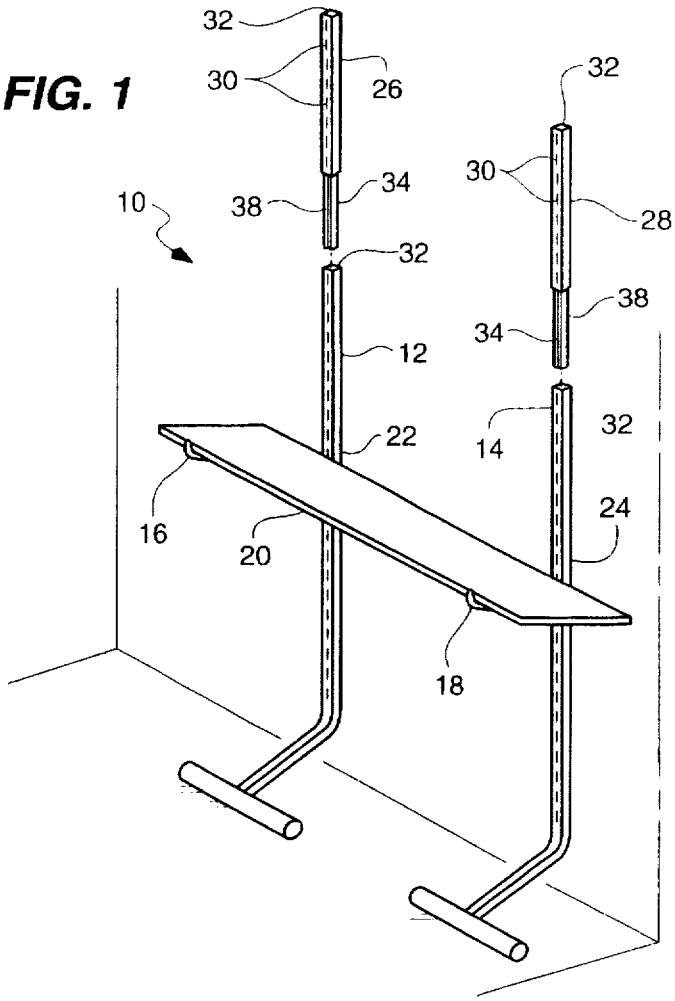
FIG. 1 is a perspective view of a shelf support system having a pair of segmental support members cooperative with complimentary cantilever brackets to support a shelf board wherein the uppermost segmental portions of the support members are exploded from lower segmental portions of the support members.

Referring now to the drawings, there is shown in FIG. 1 a shelf support system 10 using posts 12 and 14 (support members) cooperative with cantilever brackets 16 and 18 to support a shelf board 20. The posts 12 and 14 are segmented into lower sections 22 and 24 and upper sections 26 and 28, respectively, thereby forming a plurality of segments comprising posts 12 and 14. Posts 12 and 14 each have a plurality of vertically aligned slots 30 capable of removably receiving seating hooks of cantilever brackets 16 and 18. Posts 12 and 14 each have a hollowed open end 32 at both their upper and lower segments.

Upper post sections 26 and 28 are connected to the lower sections 22 and 24, respectively, by means of joinder piece 34 constructed in accordance with the teachings of the present invention.

Figure 5:
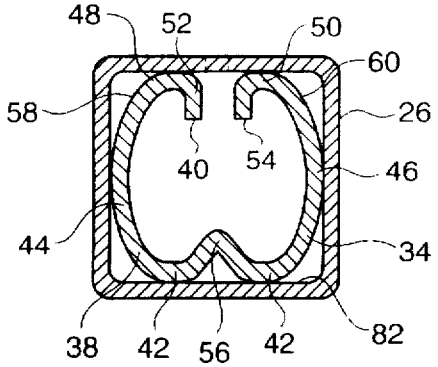
FIG. 5 is a cross-sectional view of the joinder piece illustrated in FIGS. 3 and 4 and is taken at line 5—5 of FIG. 6.

Joinder piece 34 is illustrated at FIGS. 3 through 6. Referring to FIG. 5, there is shown a cross-sectional view of the joinder piece 34 mounted within a segmental support member 26. The segmental support member 26 is preferably an extruded tubular integral metal piece, polygonal in cross section and preferably square. Joinder piece 34 comprises a generally C shaped elongate body 38, having an open channel 40. The elongate body 38 has a base portion 42, a first side portion 44 and a second side portion 46 wherein the side sections border the base portion to form open channel 40 opposite ridge 56 of base portion 42. Open channel 40 preferably runs the entire length of joinder piece 34. The first and second side portions 44 and 46 preferably include flanges 48 and 50 extending inwardly towards each other before ending into an downwardly extending folds 52 and 54, respectively. The flanges 48 and 50 and the folds 52 and 54, vis-a-vis each other, in part define the open channel 40. When the elongate body is inserted into a segmental support member having aligned slots to receive seating hooks of a cantilever bracket, the open channel 40 has a width and depth suited to accommodate the seating hooks of a cantilever bracket inserted into the support member aligned slots.

As best illustrated in the cross-sectional view of FIG. 5, the base portion 42 of elongate body 38 has an inwardly extending ridge 56 which preferably extends the entire length of the base portion. The inwardly extending ridge 56 is aligned opposite the open channel 40.

Figure 3:
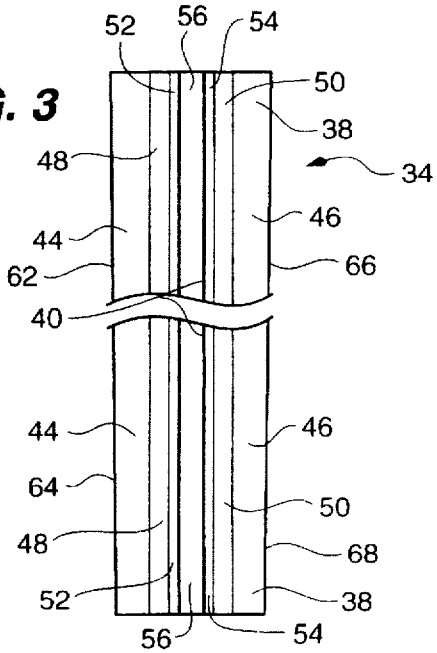
FIG. 3 is a front vertical view of a joinder piece constructed in accordance with the teachings of the present invention.
Figure 4:
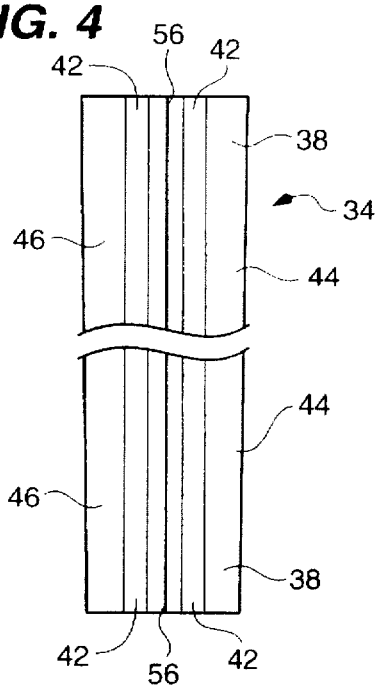
FIG. 4 is a rear vertical view of the joinder piece illustrated in FIG. 3.

The first and second side portions 44 and 46 each have a contour 58 and 60 curved towards each other. The contours 58 and 60 foster a capability of inward movement of the first and second side portions towards each other to accomplish an interference fit of the joinder piece into a segmental support member. In this regard the joinder piece 34 is manufactured as an integral unit preferably of a resilient steel or other suitable resilient strong material. As shown at FIG. 3, the joinder piece 34 preferably has an upper half portion 62 and a lower half portion 64. The upper half portion 62 is preferably permanently affixed within a support member while the lower half portion 64 is left exposed for selective and removable placement within an open end of a complimentary segmental support member. The upper half portion 62 of joinder piece 34 is of a suitable width and length to accomplish a locked engagement within the segmental support member with which it is permanently joined. In this regard, upper half portion 62 of joinder piece 34 is preferably of a slightly larger diameter 66 than the slightly smaller diameter 68 of lower half portion 64. The resilient first and second side portions 44 and 46 of upper half portion 62 of the joinder piece 34 may be forced by suitable mechanical means from their original position toward each other such that, when upper half portion 62 has been inserted into a complimentary segmental support member, removal of the force on the first and second side portions allows the same to return from their inwardly forced disposition to achieve a permanent locked interference fit of the upper portion 62 of the joinder piece 34 within the segmental support member. The lower half portion 64 of the joinder piece 34 thus remains exposed from the segmental support member for selective and removable insertion into a hollowed open end of another complimentary segmental support member to thereby join the segmental support members, or interconnect additional support members so connected, into a cooperative aligned post or completed support member system.

Figure 2:
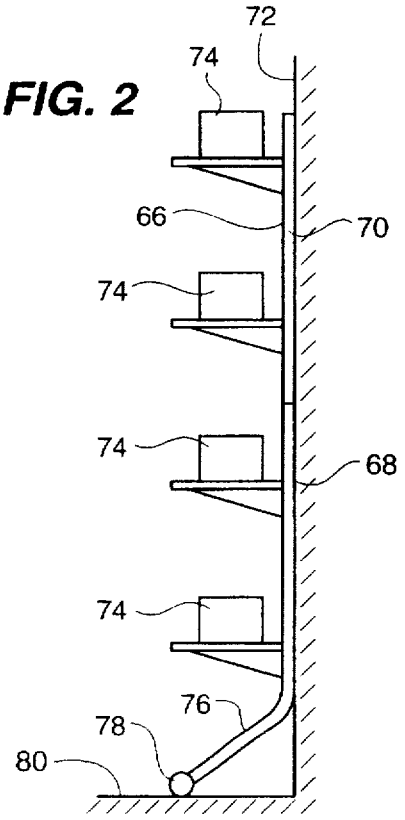
FIG. 2 is a side view of a shelf support system similar to FIG. 1 but now showing additional cantilever brackets supporting shelf boards bearing a load.
Figure 6:
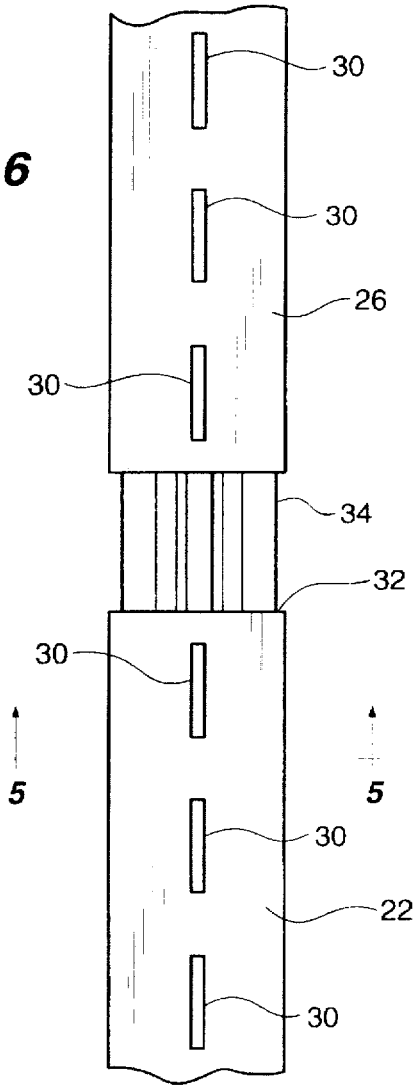
FIG. 6 is a front vertical view of a joinder piece according to the present invention fixedly mounted within an upper segmental support member and shown to be partially inserted into a lower segmental support member.

The capacity of the first and second side portions of the joinder piece to accommodate movement towards each other allows the permanent locked fit of joinder piece 34 to first upper segmental support member 26 of FIG. 6. Thereafter, the externally exposed lower half portion 64 of joinder piece 34 has a sufficient length such that it can be axially aligned with and inserted into an open end 32 of another complimentary sectional or segmental support member, such as second lower support member 22 of FIG. 6, to form a completed post such as combined post unit 66 illustrated at FIG. 2.

The base portion 42 of the joinder piece 34 plays an additional role in achieving a stabilization of joined segmental support members within a shelf or load supporting system. As observed in FIG. 2, segmental support members 68 and 70 form combined post unit 66 which, when part of a load bearing support system, is in friction engagement with supporting wall surface 72. The force of load 74 is mainly supported by leg 76 and traverse foot 78 upon floor surface 80 but is partially supported by the joinder piece of the present invention. In particular, the base section 42 of joinder piece 34 is capable of transferring a load induced force rearward to the rear surface 82 of support member 26 within which it is disposed (see FIG. 5). This is due to a partial flattening effect of the load upon the inwardly extending ridge 56 which transfers part of the load induced force to base portion 42 and thereby upon rear surface 82 of the support member 26 within which the joinder piece 34 is disposed to aid in the frictional engagement of the support member 26 to supporting wall surface 72 both in the direction directly against the wall and against moving or sliding in transverse directions, i.e. along the surface of the wall.

Figure 7:
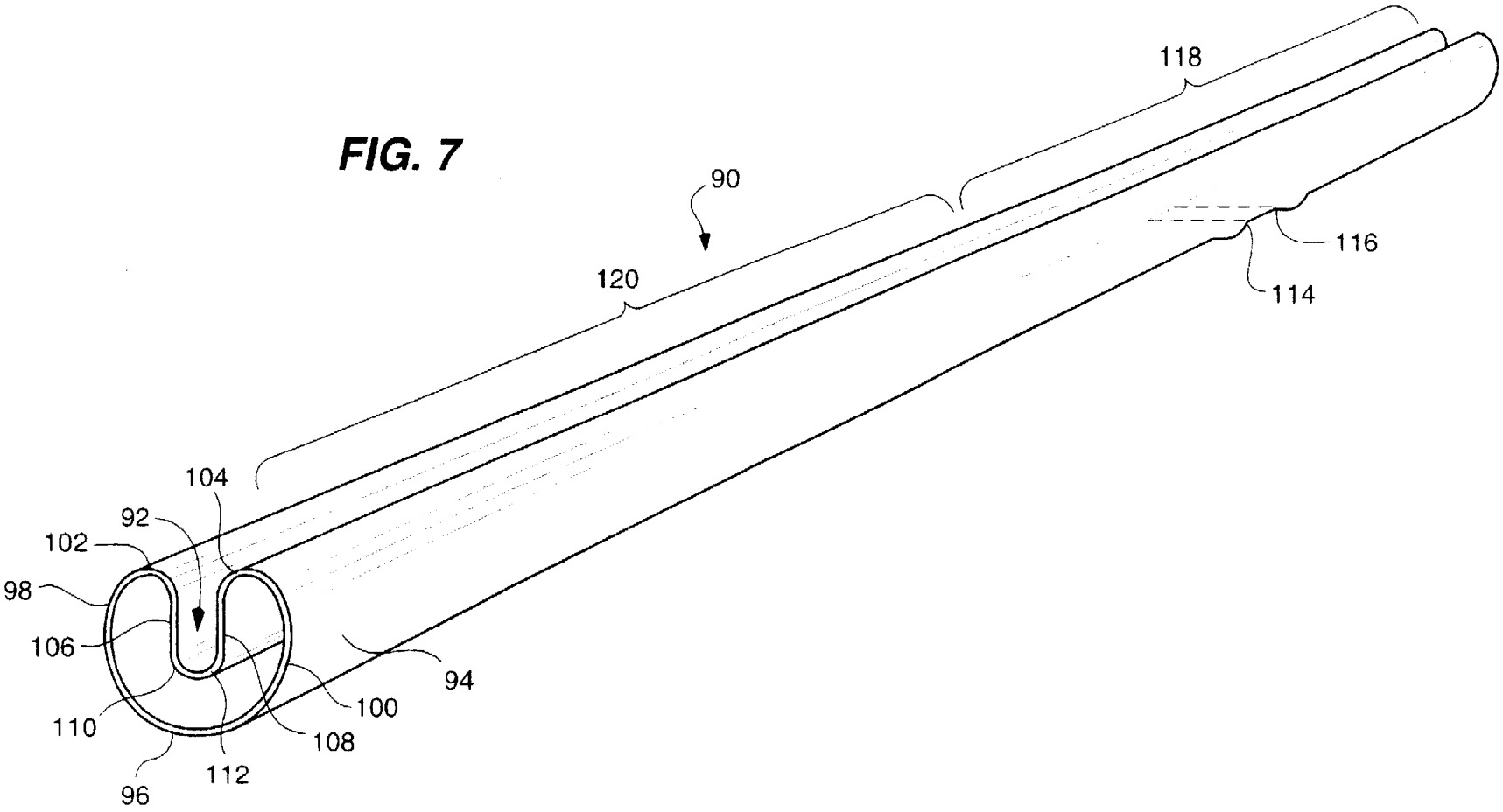
FIG. 7 is a perspective view of another embodiment of a joinder piece constructed in accordance with the teachings of the present invention.

Referring now to FIG. 7 there is illustrated a perspective view of another embodiment of the joinder piece of the present invention. Joinder piece 90 is similar to joinder piece 34 shown at FIG. 3 but now has a trough 92 instead of open channel 40. Joinder piece 90 comprises an elongate body 94 having trough 92, the elongate body having a base portion 96, a first side portion 98, and a second side portion 100. The first and second side portions 98 and 100, each bordering the base portion 96, each have an inwardly extending flange 102 and 104, respectively. Inwardly extending flanges 102 and 104 each terminate into a downwardly extending fold 106 and 108, respectively. Each of the downwardly extending folds 106 and 108 have a curved branch 110 and 112, respectively, which join to form trough 92. Thus, joinder piece 90 is generally U-shaped in end view cross section with trough 92 being capable of being disposed in alignment with a plurality of aligned slots of a sectional or segmented support member so as to receive seating hooks of a cantilever bracket. Trough 92 preferably extends the length of elongate body 90 opposite base portion 96.

The first and second side sections 98 and 100 of joinder piece 90, similar to joinder piece 34, each have a contour curved towards each other which is resilient and capable of inward movement towards each other to foster an interference fit of joinder piece 90 into a sectional or segmented support member.

Figure 8:
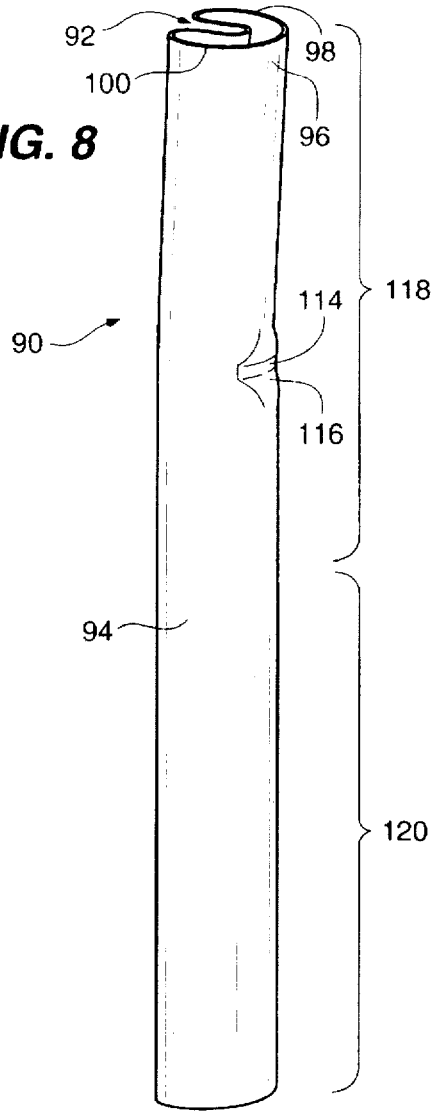
FIG. 8 is a side view of the joinder piece illustrated in FIG. 7.

In FIG. 7 and the side view of FIG. 8, there is also illustrated an indentation 114 in the external surface 116 of base portion 96 which preferably extends substantially across the width of joinder piece 90. Thus, the indentation 114 divides the base portion 96 into a first base portion section 118 and a second base portion section 120 which are non-linear along their combined external base portion surfaces. In this regard, one of the first and second base portion sections 118 and 120 (for example, the first base portion section 118 illustrated at FIGS. 7 and 8) has its external base portion surface biased in a direction extending opposite of trough 92. This section is designed to be permanently mounted into a sectional or segmented support member while the other base portion section (i.e., the second base portion section 120 in FIGS. 7 and 8) is designed to be externally exposed from such sectional or segmented support member. The initial bias of the external base portion surface of first base portion section 118 in a direction opposite trough 92 achieves several benefits. First, the initial bias in a direction opposite the trough disposes the external base portion surface of first base portion section 118 towards a supporting wall surface (see 72 at FIG. 2) when the joinder piece 90 is placed within a sectional or segmented support member. This aids the sectional or segmented support member in achieving a favored stabilized position against a supporting wall surface. Further, when the segmented support member bears a load from a shelf structure system, the external base portion surface of first base portion section 118 is resilient and capable of a movement towards the trough 92 upon bearing the force of the load upon the sectional or segmented support member. Thus, although the first base portion section 118 may start in a distorted position biased to a wall surface, a load upon the sectional or segmented support member has a straightening effect upon the first base portion section 118. Thus, indentation 114 serves to give base portion 96 a load bearing capacity.

Figure 11:
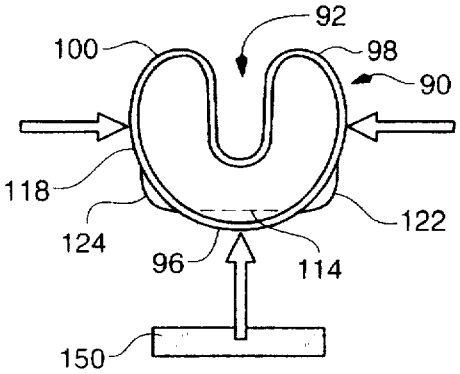
FIG. 11 is a schematic end view of side press deformation steps and a base press indentation step to the intermediate stage of the joinder piece illustrated at FIG. 10 in the method of making the joinder piece of FIG. 7.

Indentation 114 to base portion 96 also forms bulge points 122 and 124 bordering the indentation 114 (see FIG. 11). Bulge points 122 and 124 play an important role in achieving an interference fit of the first base portion section 118 within a sectional or segmented support member. In this regard first base portion section 118 may be forced by air, hydraulic, or mechanical press machine means known in the art into a sectional or segmented support member (with trough 92 facing the aligned slots, which receive seating hooks of a cantilever bracket, of the sectional or segmented support member) such that release of the insertion force will allow bulge points 122 and 124 to effectively lock first base portion section 118 within the sectional or segmented support member to permanently mount the same therein.

Figure 12:
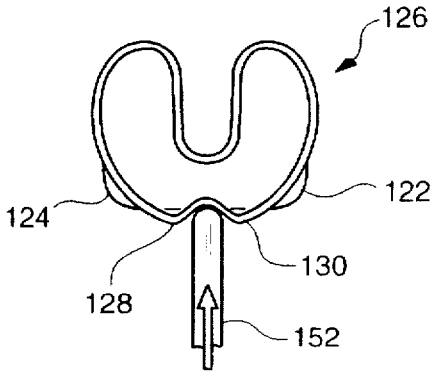
FIG. 12 is a schematic end view of a further optional press deformation step to form a inward ridge to the base portion of joinder piece illustrated at FIG. 11.

As illustrated in FIG. 12, joinder piece 126 may be provided with an inwardly extending ridge 128 along at least a part of the length of base portion 130. The inwardly extending ridge 128 has the same load bearing characteristic of inwardly extending ridge 56 of joinder piece 34, namely that a shelf structure load provides a partial flattening effect upon the inwardly extending ridge 128 which transfers a part of the load induced force to base portion 130 of joinder piece 126 and thereby upon a rear surface of the support or segmented support member within which joinder piece 126 is disposed to thereby aid in the frictional engagement of the support member to a supporting wall surface both in a direction directly against the wall and against moving or sliding in traverse directions, i.e. along the surface of the wall.

Joinder piece 34 may be prepared by conventional roll forming metal process or techniques known in the art. For example, one would start with a coil steel strip and feed the same through a series of rollers which gradually and in several continuous steps deforms the ribbon coil steel strip into the final depicted joinder piece 34.

Figure 9:
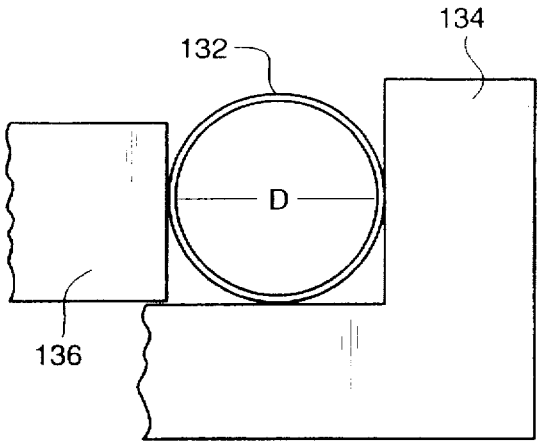
FIG. 9 is a schematic end view of a starting position of a method for making the joinder piece illustrated at FIG. 7.
Figure 10:
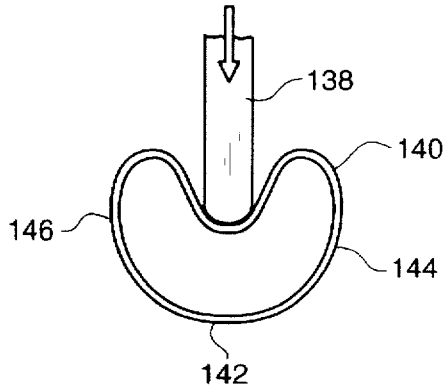
FIG. 10 is a schematic end view of a press deformation step in the method of making the joinder piece shown at FIG. 7 which forms an intermediate stage of the joinder piece.

Alternatively, FIGS. 9 through 12 schematically illustrate a method of manufacturing joinder pieces 90 and 126 which advantageously is less complex. In this regard FIG. 9 shows a starting position wherein round tube 132 is fixly held against base member 134 by pressure slide bar 136. Round tube 132 may be a carbon steel tube, for example grade 1010, having an initial diameter D of 1.5 inches. As illustrated in FIG. 10, round tube 132 is subjected to a press deformation, for example by press member 138, along its entire length to form intermediate indented tube 140 which has an intermediate base portion 142, an intermediate first side portion 144 and an intermediate second side portion 146. The press deformation may be by air, hydraulic, or mechanical press machine means known in the art. Next, as illustrated in FIG. 11, the intermediate first side portion 144 and the intermediate second side portion 146 of intermediate indented tube 140 are each alternatively subjected to a lateral press force, for example of pressure slide bar 136 (see FIG. 9), in a direction generally 90 degrees to the first press deformation direction illustrated at FIG. 10. The lateral press force may likewise be by air, hydraulic, or mechanical press machine means known in the art. This effectively brings the intermediate first side portion 144 and the intermediate second side portion 146 closer to each other to form trough 92 and the first side portion 98 and the second side portion 100 bordering base portion 96 depicted in FIG. 11. As further illustrated in FIG. 11, an indenting force can be applied, for example by indention bar 150, to form the indentation 114 along the width of base portion 96. The indenting force may likewise be by air, hydraulic, or mechanical press machine means known in the art. The indentation will cause a bulging of the substantially U-shaped tube at bulge points 122 and 124 and will divide the base portion 96 into first and second base portion sections 118 and 120 having a non-linear combined external base portion surface as heretofore discussed.

FIG. 12 illustrates an optional step of applying a ridge forming force, for example by ridge forming bar 152, to joinder piece 126 to thereby form the inwardly extending ridge 128 along at least part of the length of base portion 130. The ridge forming force may likewise be by air, hydraulic, or mechanical press machine means known in the art.

The dimensions of the joinder piece can be varied to suit a variety of segmental support members. For example the segments of support members may consist of two foot lengths with a outer tube of one inch square. A joinder piece of one inch diameter in its upper portion and slightly less in its lower portion may be 18 inches in length allowing nine inches to be permanently locked into one segmental support member and the remaining nine inches for selective and removable insertion into an open hollowed end of a second complimentary segmental support member.

From the foregoing description, it will be apparent that the joinder piece for connection of segmental support members the present invention has a number of advantages, some of which have been described above and others of which are inherent in the invention. Also, it will be understood that modifications can be made to the joinder piece or its environment of use described above without departing from the teachings of the present invention. Accordingly, the scope of the invention is only to be limited as necessitated by the accompanying claims.

I claim:

1. A joinder piece for connection of sectional or segmental support members, at least one of said support members having a plurality of aligned slots to receive seating hooks of a cantilever bracket, comprising an elongate body having an opening, said elongate body having a base portion, a first side portion, and a second side portion, said first and second side portions each having a contour at least partially inwardly curved toward each other which is capable of contact with a substantially linear interior surface of at least one of said support members, said first and second side Portions being resilient and capable of inward movement towards each other to foster an interference fit within at least one of said support members, said first and second side portions bordering said base portion to form said opening, said opening being capable of being disposed in open communicative alignment with said plurality of aligned slots of said support member.

2. The joinder piece of claim 1 wherein said base portion of said elongate body has an inwardly extending ridge.

3. The joinder piece of claim 2 wherein said inwardly extending ridge is disposed along the length of said base portion opposite said opening of said elongate body.

4. The joinder piece of claim 2 wherein said inwardly extending ridge of said base portion is resilient and capable of partially transferring a load induced force to at least one of said support members to aid in the disposition of said support member to a supporting surface.

5. The joinder piece of claim 1 wherein said opening of said elongate body extends the length of said elongate body opposite said base portion.

6. The joinder piece of claim 1 wherein said first and second side portions each include an inwardly extending flange.

7. The joinder piece of claim 6 wherein said flange of each of said first and second side portions has an downwardly extending fold.

8. The joinder piece of claim 1 in combination with a sectional or segmental support member.

9. The combination of claim 8 further including a cantilever bracket connected to said sectional or segmental support member.

10. The combination of claim 9 further including a shelf or hand rod to form a support system.

11. The joinder piece of claim 1 wherein said base portion includes an indentation in its external surface.

12. The joinder piece of claim 11 wherein said indentation extends substantially across the width of said base portion external surface.

13. The joinder piece of claim 12 wherein said indentation creates a bulge point bordering each side of said indentation.

14. The joinder piece of claim 11 wherein said indentation divides said base portion into a first base portion section and a second base portion section wherein said first and second base portion sections are non-linear along their combined external surfaces.

15. The joinder piece of claim 14 wherein one of said first or second base portion sections has at least a part its external surface biased in a direction extending opposite said opening.

16. The joinder piece of claim 15 wherein said biased external surface of said base portion section is resilient and capable of inward movement opening said trough upon bearing the force of a load.

17. A joinder piece for connection of sectional or segmental support members, at least one of said support members having a plurality of aligned slots to receive seating hooks of a cantilever bracket, comprising an elongate body having a trough, said elongate body having a base portion, a first side portion, and a second side portion, said first and second side portions each having a contour at least partially inwardly curved toward each other which is capable of contact with a substantially linear interior surface of at least one of said support members, said first and second side portions being resilient and capable of inward movement towards each other to foster an interference fit within at least one of said support members, said first and second side portions each bordering said base portion and having an inwardly extending flange, each of said inwardly extending flanges having a downwardly extending fold, each of said downwardly extending folds having a curved branch which join to form said trough, said trough being capable of being disposed in open communicative alignment with said plurality of aligned slots of said support member.

18. The joinder piece of claim 17 wherein said elongate body is generally U-shaped.

19. The joinder piece of claim 17 wherein said base portion of said elongate body has an inwardly extending ridge.

20. The joinder piece of claim 19 wherein said inwardly extending ridge is disposed along at least a part of the length of said base portion opposite said trough of said elongate body.

21. The joinder piece of claim 19 wherein said inwardly extending ridge of said base portion is resilient and capable of partially transferring a load induced force to at least one of said support members to aid in the disposition of said support member to a supporting surface.

22. The joinder piece of claim 17 wherein said trough of said elongate body extends the length of said elongate body opposite said base portion.

23. The joinder piece of claim 17 in combination with a sectional or segmental support member.

24. The combination of claim 23 further including a cantilever bracket connected to said sectional or segmental support member.

25. The combination of claim 24 further including a shelf or hang rod to form a support system.

26. The joinder piece of claim 17 wherein said base portion includes an indentation in its external surface.

27. The joinder piece of claim 26 wherein said indentation extends substantially across the width of said base portion external surface.

28. The joinder piece of claim 27 wherein said indentation creates a bulge point bordering each side of said indentation.

29. The joinder piece of claim 26 wherein said indentation divides said base portion into a first base portion section and a second base portion section wherein said first and second base portion sections are non-linear along their combined external surfaces.

30. The joinder piece of claim 27 wherein one of said first or second base portion sections has at least a part its external surface biased in a direction extending opposite said trough.

31. The joinder piece of claim 30 wherein said biased external surface of said base portion section is resilient and capable of inward movement toward said trough upon bearing the force of a load.

* * * * *